US005595135A

United States Patent [19]

Jensen

[11] Patent Number: 5,595,135

[45] Date of Patent: Jan. 21, 1997

[54] ARRANGEMENT FOR TOWING OF A DISABLED SHIP

[76] Inventor: Jon B. Jensen, 240 Viborgvej, DK-7840 Højslev, Denmark

[21] Appl. No.: 535,075

[22] PCT Filed: May 4, 1994

[86] PCT No.: PCT/DK94/00179

§ 371 Date: Dec. 29, 1995

§ 102(e) Date: Dec. 29, 1995

[87] PCT Pub. No.: WO94/25336

PCT Pub. Date: Nov. 10, 1994

[30] Foreign Application Priority Data

May 5, 1993 [DK] Denmark ..... 0513/93

[51] Int. Cl.[6] ..... B63B 21/04

[52] U.S. Cl. ..... 114/253; 114/311

[58] Field of Search ..... 441/1, 6, 7, 9, 441/11, 20, 21–23, 24–27, 30, 32; 114/242, 253, 254, 311

[56] References Cited

U.S. PATENT DOCUMENTS

| | | | |
|---|---|---|---|
| 2,341,799 | 2/1944 | Luby | 441/7 |
| 3,123,842 | 3/1964 | Oeland, Jr. et al. | 441/9 |
| 4,330,895 | 5/1982 | Putman et al. | 441/22 |

FOREIGN PATENT DOCUMENTS

| | | | |
|---|---|---|---|
| 751750 | 9/1933 | France | 114/311 |
| 2050363 | 4/1971 | France . | |
| 2337660 | 8/1977 | France . | |
| 2626546 | 8/1989 | France . | |
| 1118041 | 11/1961 | Germany . | |
| 1174200 | 7/1964 | Germany . | |
| 85046 | 2/1955 | Norway . | |

*Primary Examiner*—Edwin L. Swinehart

*Attorney, Agent, or Firm*—Kerkam, Stowell, Kondracki & Clarke; Dennis P. Clarke

[57] ABSTRACT

An arrangement for towing a disabled ship comprising a wire on a wire drum having an axis extending in a longitudinal direction of a ship at the stern or stem of the ship, the wire being permanently connected with the ship at one end behind the drum and at the other end with a painter, the painter being a buoyant line stored in a magazine in which it is coiled without being twisted, the magazine being placed between the wire drum and a launching pipe for a buoy with which the other end of the painter is connected wherein the buoy is inflatable and connected with and encapsuled in a box in the form of a floating anchor, the box being launchably mounted in the launching pipe.

8 Claims, 2 Drawing Sheets

ARRANGEMENT FOR TOWING OF A DISABLED SHIP

BACKGROUND OF THE INVENTION

1. Field of the Invention

The present invention relates to an arrangement for the towing of a disabled ship by means of a wire prepared for that purpose, said wire being connected with a buoy adapted to be released in connection with a disabling of the ship.

2. Discussion of the Prior Art

Several cases are known, in which the engine of a tanker has broken down and where the ship has run aground and sprung a leak, following which a major or minor part of the cargo has leaked and caused considerable pollution of the coast, where the tanker has run aground. It has been said that an accident of this kind in recent times would have been avoided in recent times if the disabled ship had been provided with a wire prepared for the towing of the ship, said wire being connected with a buoy, which has been disengaged from the disabled ship and which is provided with a painter, by means of which a salvage ship could pull a wire free and rig a tow wire without having to put any persons on board the disabled ship. This arrangement has been proposed in the magazine SEAWAYS, March, 1993, p. 31. In this known arrangement the buoy is connected with the disabled ship at the port side somewhat astern of midship. In the proposed arrangement there is a great possibility that the buoy will come to rest against the ship's side and consequently be inacessible to a salvage ship which is to prepare for a towing.

The object of the present invention is to provide an arrangement of the kind mentioned by way of introduction, by means of which arrangement a great possibility exists that a salvage ship can establish a tow wire by means of which the disabled ship can be towed away from the endangered coast.

SUMMARY OF THE INVENTION

According to the invention this object is met by an arrangement in combination with and for the towing of a disabled ship by a wire prepared for that purpose, the wire being connected with a buoy adapted to be released from, in connection with a disabling of, the ship. The wire is placed on a wire drum having an axis extending in the longitudinal direction of the ship at the stern, stem or stern and stem of the ship. The wire is permanently connected with the ship at one end behind the drum and at the other end with a painter. The painter is a buoyant line stored in a magazine, in which it is coiled without being twisted, the magazine being placed between the wire drum and a launching pipe for a buoy, with which the other end of the painter is connected. The buoy is inflatable and connected with and encapsuled in a box comprising a floating anchor, the box being launchably mounted in the launching pipe.

The invention is based on the fact that a ship without any propellent force will take up a position transversely to the moving direction of the prevailing sea. A tall bridge or living quarters placed for instance astern influence to a certain extent the direction of the ship in relation to the sea, but the deviation from transverse perpendicularly to the sea will hardly exceed 10°–15°. A comparatively small floating anchor will therefore pull out its painter in a direction which substantially forms a right angle to the longitudinal direction of the ship and at all events keep clear of the ship. Furthermore, the invention is based on the experience that at open sea it is possible to approach two ships stem against stem, and that even during very rough weather it is possible to approach the ships as much as 20–50 m, without any serious risk, in particular when the ships—as will be the case in this connection—are not positioned straightly opposite one another. In the arrangement according to the invention an inflatable buoy can be launched from the stem of the disabled ship, said buoy marking a painter in form of a buoyant line which is connected with the tow wire and which can be used for release thereof from the magazine in which it has been coiled. The buoy is provided with a floating anchor ensuring that it will effectively be kept at a distance corresponding to the length of the buoyant line from the disabled ship, partly because the ship drifts approximately perpendicularly to the moving direction of the prevailing sea, partly because the floating anchor, which impedes the drift of the buoy, will keep the painter stretched out perpendicularly to the disabled ship. The buoy is comparatively simple to bring on board the salvage ship, and by pulling the buoyant line, the tow wire is released and can then be fastened to the towing hook of the salvage ship, following which the towing can start. In case of a ship, which has been so seriously disabled that the crew has to abandon the disabled ship, the encapsuled buoy which is placed in a launching pipe in the forecastle of the ship is released before the ship is abandoned, whereby the buoyant line and the buoy disengage themselves from the disabled ship.

The arrangement is normally placed in the forecastle of the ship, but a similar arrangement may be placed astern.

To mark the buoyant line in darkness and under conditions with bad visibility it is according to the invention preferable that the buoyant line is fluorescent.

According to the invention the floating anchor is connected with the buoy by means of a line, the length of which is bigger than the maximum draught of the ship. By letting the anchor be at a bigger depth than the draught of the ship, an increased security against the buoy having less drift than the ship is attained, and it can therefore keep clear of the stem of the ship.

To secure the towing wire on the drum and to protect it until it is to be used, the wire drum has a conical core and is nested in a likewise conical housing which by means of a spring is pressed against the core, the wire being by means of the spring force secured between the core and the housing. When the painter is collected by a salvage ship, she will be able to pull the towing wire out over the end of the conical core by means of the painter. The wire is positioned in the interspace between the core and the housing, protected until it is to be used, and can be protected against corrosion by means of a suitable grease.

According to the invention the core has a longitudinal groove, through which the end of the wire connected with the ship is passed, the depth and direction being such that the wire can be brought to extend substantially rectilinearly from the connection point through the groove to the launching pipe. This embodiment reduces the forces acting on the individual parts during the towing.

The buoy is to be inflated, when the painter is launched. According to an embodiment of the invention this may be done by means of a gas cartridge which is released when lowered into water. In this way the inflation will not take place until the painter and the buoy is clear of the ship.

Alternatively, the gas cartridge may be provided with a release line which is connected with the ship, which secures against erroneous release, if water enters the launching pipe.

The box preferably consists of two halves which are hinged at the part being foremost in the launching pipe and which at the hinge are connected with the line to the buoy. The two halves open after the launching and thereby form an effective floating anchor which impedes the drift of the buyo.

By means of a wire drum with a length of 2 m and a diameter of likewise 2 m at the widest end, it will be possible to store a towing wire of 200 m, which will in practice be a suitable length for the purpose.

According to the invention the box is provided with a rearwards facing shaft, the length of which substantially corresponds to the length of the launching pipe, and which is passed through a substantially tight-fitting opening in the bottom of the launching pipe, the painter being connected with the shaft and the propellant medium being supplied to the interspace between the bottom and the box. In this embodiment the volume, which during launching is to be put under pressure, will be comparatively small, and the building up of pressure will therefore take place quickly, which ensures a sufficiently long-range launching.

BRIEF DESCRIPTION OF THE DRAWINGS

The invention will be described in detail in the following with reference to the drawing, in which.

DESCRIPTION OF PREFERRED EMBODIMENT

Figure 1:
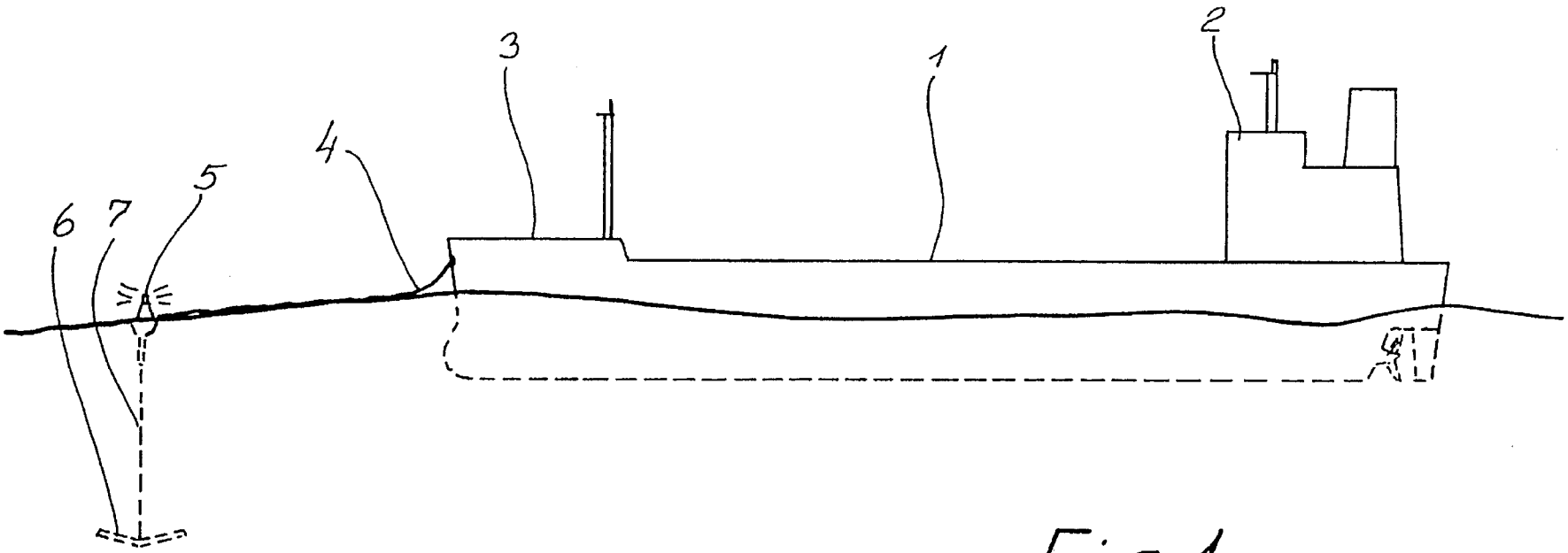
FIG. 1 shows a disabled ship with a launched painter.

The disabled ship 1 shown in FIG. 1 has lost its drive. She will, therefore, take up a position transversely to the prevailing sea. The wind pressure on bridge and quarters 2 will, however, lead to the ship drifting with the wind, the stern being somewhat ahead of the stem, but the deviation from the direction transversely to the sea will hardly exceed 10°–15° . To enable a salvage ship to tow the disabled ship, which may have been abandoned by her crew, a painter 4 has been launched from the forecastle 3 of the ship, to which line a buoy 5 has been fastened. The buoy is connected with a floating anchor 6 by means of a line 7 which is longer than the draught of the ship 1. The painter 4 is a buoyant line which is preferably fluorescent or in another way made easilily visible even in darkness or under other conditions with poor visibility. To make the buoy more visible, it is preferably provided with a lantern, which is activated when the buoy is brought afloat on the water.

On account of the floating anchor 6 the buoy 5 drifts more slowly than the ship 1, and the buoyant line 6 will therefore be substantially straight. The buoy 5 therefore stays at such a suitable distance from the disabled ship 1 that the salvage ship even under unfavourable weather conditions comparatively without risk can approach the disabled ship and collect the buoy in order to get hold of the painter. The painter 4 does not have sufficient strength for being used as a towing line, but it is strong enough to be used for pulling a towing wire permanently rigged on the disabled ship free from the magazine in which it is stored.

The arrangement according to the invention comprises means for launching the buoy 5 from the forecastle 5, when a hopeless situation arises for the ship, the painter 4 becoming released. The buoy is during the storing in the forecastle of the ship encapsuled in two box halves which after the launching is to act as the floating anchor 6.

By means of the arrangement according to the invention a salvage ship will get considerably improved possibilities of salving a disabled ship in the open sea or at least in the first round of preventing the ship from drifting towards a coast, where the ship might be stranded and possibly leak an oil cargo which would create a long-lasting pollution of the beaches on the coast in question.

Figure 2:
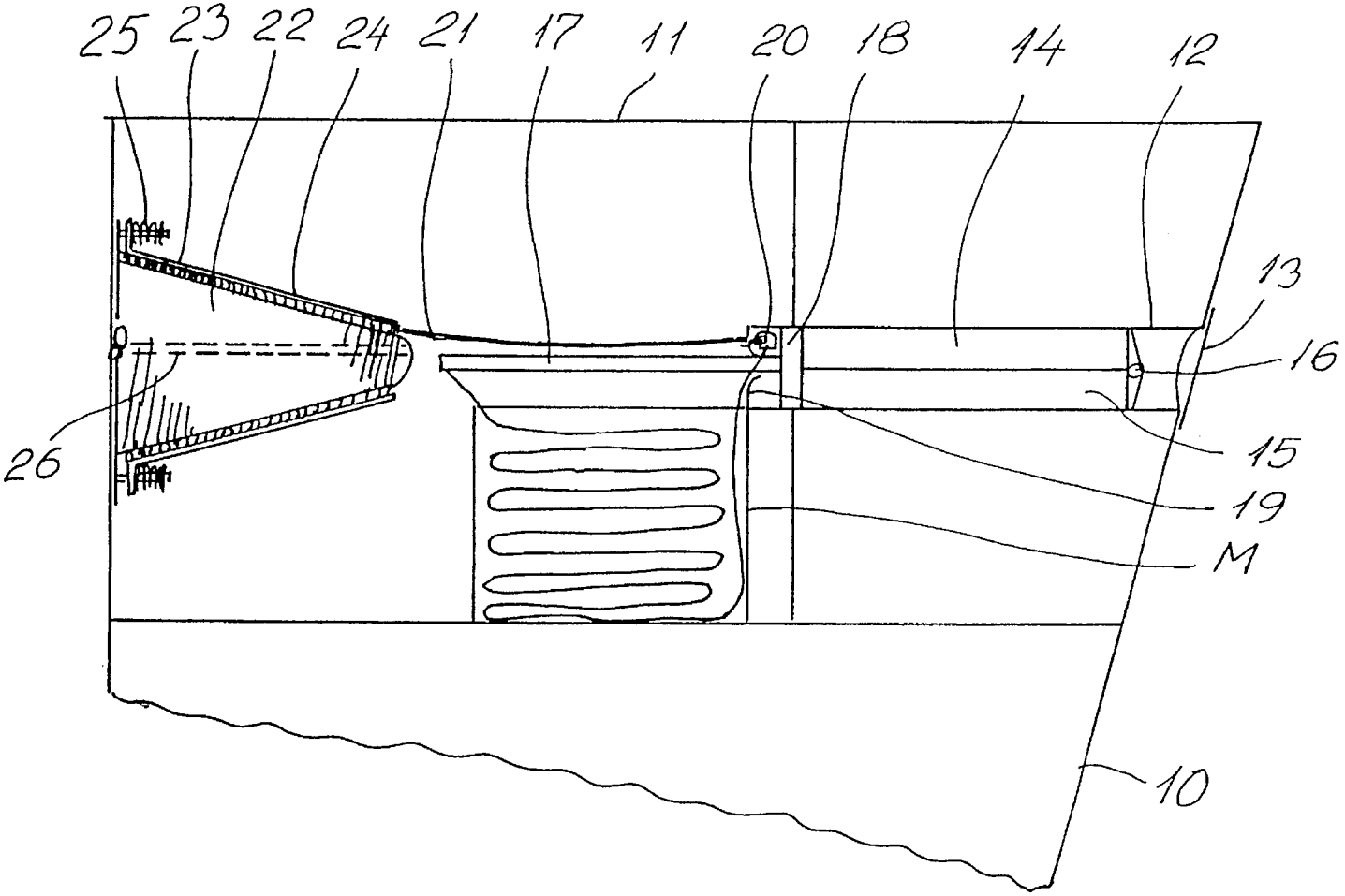
FIG. 2 shows a section through the forecastle of a ship which is provided with an arrangement for launching a painter and with a coiled up towing wire.

The part of the arrangement, which is installed in the forecastle of the ship, may according to the invention be designed as shown in FIG. 2, which shows a section through the front part of a ship with her stem 10 and front deck 11. In the stem a launching pipe 12 is mounted, which under normal conditions is covered by a plate 13, which can be released at the launching of the buoy, but which under normal conditions is able to prevent water from entering the launching pipe 12. The launching pipe is placed in a plane through the centre line of the ship and contains the inflatable buoy 5 according to FIG. 1 encapsuled in the floating anchor. The floating anchor and the buoy are therefore combined to a kind of projectile 14. This projectile comprises an outer box which substantially consists of the two wings 15 of the floating anchor, which at the front end of the box is connected by a hinge 16. Within the box the inflatable buoy is stored. The inflatable buoy is made from the same type of materials which are used for the manufacture of lifeboats, and the technique for inflating the buoy is similar to the one used in these boats. The buoy may be provided with a shaft 17 and a shoulder 18, against which the rear part of the box rests. The shoulder 18 fits slidingly into the launching pipe and may be provided with a sealing ring or lip which prevent a propellant which is introduced behind the shoulder from passing the shoulder in major amounts. The shaft 17 is passed through an opening in a bottom 19 inserted in the launching pipe, and on the rear end of the shaft the buoyant line has been fastened. The buoyant line (4, FIG. 1) is stored in a magazine M, in which is it placed without coils, so that it can be pulled out immediately without forming kinks of the opening in the bottom wall 19 at the launching of the box 14. The rear end of the buoyant line is passed through the opening in the bottom 19 and fastened to the front end 20 of the towing wire. The front end of the towing wire may be provided with a swivel which may equalize coils of the wire. Alternatively to the shaft 17, the opening in the bottom 19 may be provided with a cork, which can be pulled out when the box is launched. The cork may for instance be connected with the buoyant line 4, a sufficient length of the buoyant line being provided between the box and the cork, so that the cork is not pulled out until the box has completely left the launching pipe. By using a cork instead of a shaft 17, the box takes up less space in the forecastle of the ship, whereby more room for the drum with wire can be provided.

The towing wire 21 is winched on a conical magazine drum 22, from which it is not pulled off until the need for towing of the ship arises. The magazine drum consists of a core 23 and a housing 24. The housing 24 is pressed against the core by means of some springs 25, which in the embodiment shown is tightened against a base plate for the magazine. The core has a groove 26 which allows the wire, after having been pulled out of the magazine drum, to extend straight through the latter from its connection point behind the base plate to the launching pipe 12, which acts as a hawse-hole, to the salvage ship. The magazine drum contains 200 m towing wire, which must in most cases be considered sufficient for a towing. On account of the springs, the towing wire cannot get into disarray or be damaged in any other way, which would make it unfit for use, if necessary. The housing may be manufactured from a perforated material, which makes it possible to inspect the wire and apply a new corrosion protection to the surface.

In case of serious disableness which might result in an evacuation of the crew, the buoy will be released. It is preferable that a battery of blow cases containing a gas, for instance compressed air, is provided in the forecastle of the ship, for release of the cover 13 and for the launching of the projectile 14 for the release of the buoyant line 4. The release should be possible from the bridge of the ship and irrespective of whether the power supply of the ship at the time in question is intact or not. The release may take place via radio waves or purely mechanically or hydraulically. To prevent an inadvertent launching of the projectile 14, for instance while the ship is in port, the release mechanism is to be provided with adequate precautionary measures and for instance simultaneous activation of two release mechanisms should be required.

In the embodiment shown in FIG. 2 the box with the buoy is launched by means of a pressure gas, but the launching may also alternatively take place by mechanical means, for instance spring forces. It should be noted that it is not necessary for the functioning of the arrangement that the box is launched to the full length of the painter. If only the box is released from the ship, so that the floating anchor and the buoy are inflated, the flowing painter will on account of the drift of the ship be pulled out of its magazine.

The arrangement according to the invention increases substantially the possibility of salving a disabled ship. The arrangement is mounted under protected conditions in the forecastle of the ship and is therefore simple to keep operationally secure. The preferred place of mounting of such arrangements is the forecastle of the ship, but it is possible to increase the safety by additionally placing an arrangement in the stern of the ship. The provision astern may also be an alternative to the provision forward, as after an accident it must be considered more safe to launch the buoy from astern. The provision astern, however, entails a backwards towing of the disabled ship. After the launching of the box, it is possible for a salvage ship to catch and consequently pull out the solidly fixed towing wire without any persons having to be put on board the disabled ship.

I claim:

1. An arrangement in combination with and for towing of a disabled ship by means of a wire prepared for that purpose, said wire being connected with a buoy adapted to be released from, in connection with a disabling of, the ship, wherein the wire is placed on a wire drum having an axis extending in the longitudinal direction of the ship at the stern, stem or stern and stem of the ship, the wire being permanently connected with the ship at one end behind the drum and at the other end with a painter;

wherein the painter is a buoyant line stored in a magazine, in which it is coiled without being twisted, the magazine being placed between the wire drum and a launching pipe for the buoy, with which the other end of the painter is connected; and wherein the buoy is inflatable and connected with and encapsuled in a box comprising a floating anchor, said box being launchably mounted in the launching pipe.

2. An arrangement according to claim 1, wherein in that the buoyant line is fluorescent.

3. An arrangement according to claim 1, wherein in that the floating anchor is connected with the buoy by means of a line, the length of which is bigger than the maximum draught of the ship.

4. An arrangement according to claim 1, wherein in that the wire drum has a conical core and is nested in a likewise conical housing which by means of a spring is pressed against the core, the wire being by means of the spring force secured between the core and the housing.

5. An arrangement according to claim 4, wherein in that the core is provided with a longitudinal groove, through which the end of the wire connected with the ship is passed, the depth and direction being such that the wire can be brought to extend substantially rectilinearly from the connection point through the groove to the launching pipe.

6. An arrangement according to claim 1, wherein in that the box consists of two halves which are hinged at the part being foremost in the launching pipe and which at the hinge are connected with the line to the buoy.

7. An arrangement according to claim 1, wherein in that the length of the wire is approx. 200 m.

8. An arrangement according to claim 1, wherein in that the box is provided with a rearwards facing shaft, the length of which substantially corresponds to the length of the launching pipe, and which is passed through a substantially tight-fitting opening in the bottom of the launching pipe, the painter being connected with the shaft.

* * * * *

UNITED STATES PATENT AND TRADEMARK OFFICE

CERTIFICATE OF CORRECTION

PATENT NO. : 5,595,135

DATED : January 21, 1997

INVENTOR(S) : Jon B. JENSEN

It is certified that error appears in the above-identified patent and that said Letters Patent is hereby corrected as shown below:

On the title page, under "[56] References Cited" insert -- Seaways, March 1993, Brian Bailey, "Emergency Towing Wires," page 31 --

Column 6, in line 1 of each of claims 2-8: delete "in that"

Signed and Sealed this

Twenty-second Day of July, 1997

Bruce Lehman

*Attest:*

BRUCE LEHMAN

*Attesting Officer*

*Commissioner of Patents and Trademarks*